United States Patent [19]

Mattson

[11] 3,960,125

[45] June 1, 1976

[54] DUAL VACUUM ACTUATOR IGNITION TIMING

[75] Inventor: Richard W. Mattson, Rossford, Ohio

[73] Assignee: Eltra Corporation, Toledo, Ohio

[22] Filed: Dec. 17, 1973

[21] Appl. No.: 425,430

[52] U.S. Cl. ..... 123/117 A

[51] Int. Cl.[2] ..... F02P 5/04

[58] Field of Search ..... 123/117 A

[56] References Cited

UNITED STATES PATENTS

| | | | |
|---|---|---|---|
| 1,467,333 | 9/1923 | Riege | 123/117 A |
| 1,818,079 | 8/1931 | Meade | 123/117 A |
| 2,109,103 | 2/1938 | Cole | 123/117 A |
| 2,378,037 | 6/1945 | Reggio | 123/117 A |
| 2,470,366 | 5/1949 | Ostling | 123/117 A |
| 2,732,833 | 1/1956 | Hook | 123/117 A |
| 2,809,620 | 10/1957 | Boylan | 123/117 A |
| 3,727,596 | 4/1973 | Panhard | 123/117 A |
| 3,738,339 | 6/1973 | Huntzinger | 123/117 A |
| 3,780,713 | 12/1973 | Julian | 123/117 A |
| 3,788,290 | 1/1974 | Carter | 123/117 A |
| 3,882,836 | 5/1975 | Heine | 123/117 A |

*Primary Examiner*—Charles J. Myhre
*Assistant Examiner*—Ronald B. Cox
*Attorney, Agent, or Firm*—Robert H. Johnson

[57] ABSTRACT

A vacuum advance mechanism is disclosed for an ignition distributor on an internal combustion engine, which allows each of two independent negative pressure signals from selected sources on the engine to actuate calibrated pneumatic motors cooperating together through a summing linkage to provide the appropriate total timing advance.

1 Claim, 11 Drawing Figures

DUAL VACUUM ACTUATOR IGNITION TIMING

Figure 1:
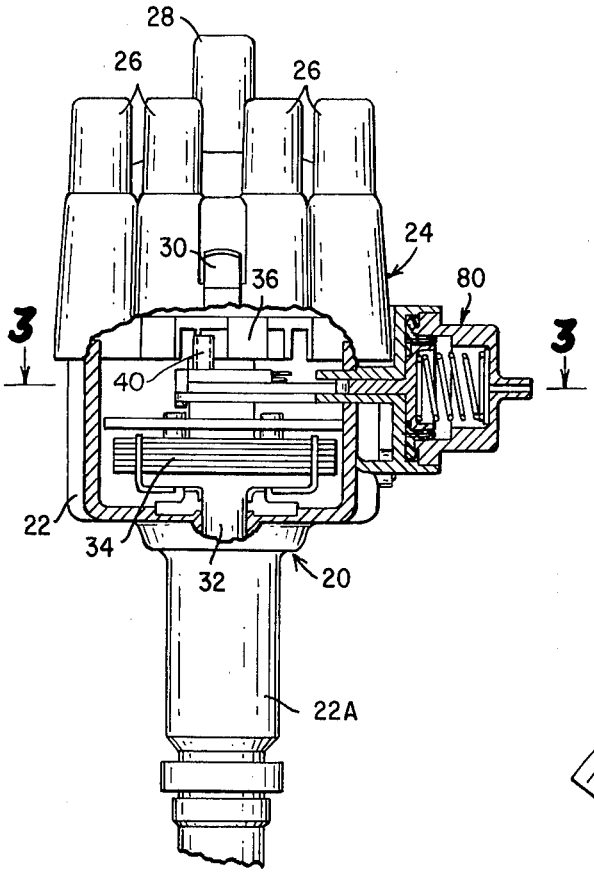

The invention relates to ignition distributors for use with internal combustion engines, wherein it is desirable to supplement the conventional manifold vacuum related advance with additional advance designed to recover engine performance when it is affected by some other parameters such as altitude or exhaust gas recirculation.

It is therefore a principle object of this invention to provide a vacuum or negative pressure responsive device for the distributor in the ignition system of an internal combustion engine, which is responsive to one or more selected negative pressures derived from the engine or from ambient atmospheric conditions.

It is a further object to provide a vacuum responsive device of the type described which is suitable for mass production and capable of being fabricated from plastic molded parts to assure economy in cost.

Other objects and advantages of this invention relating to the arrangement, operation and function of the related elements of the structure, to various details of construction, to combinations of parts and to economies of manufacture will be apparent to those skilled in the art upon consideration of the following description and appended claims, reference being had to the accompanying drawings forming a part of this specification wherein like reference characters designate corresponding parts in the several views.

Figure 2:
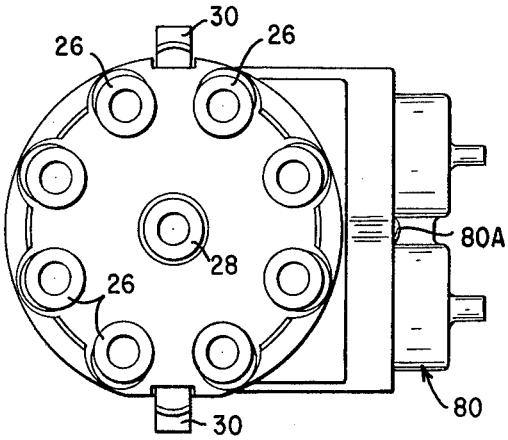
Figure 8:
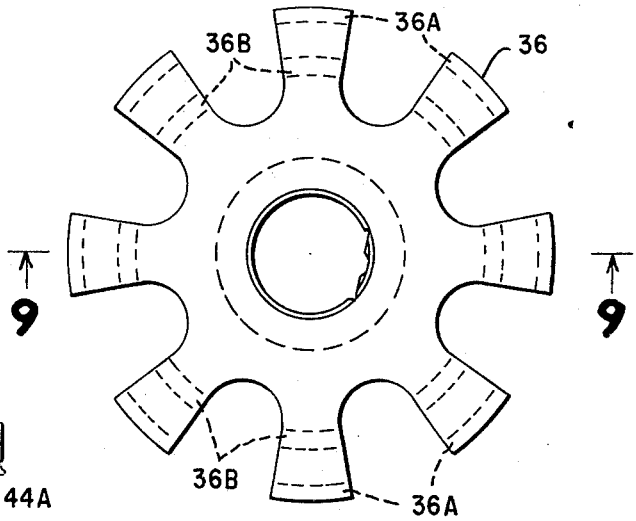
Figure 10:
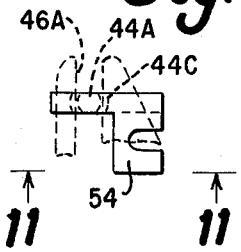
Figure 11:
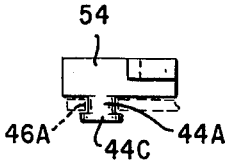
Figure 9:
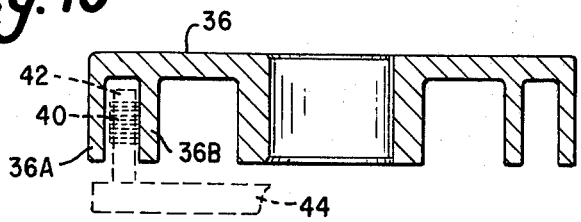
Figure 3:
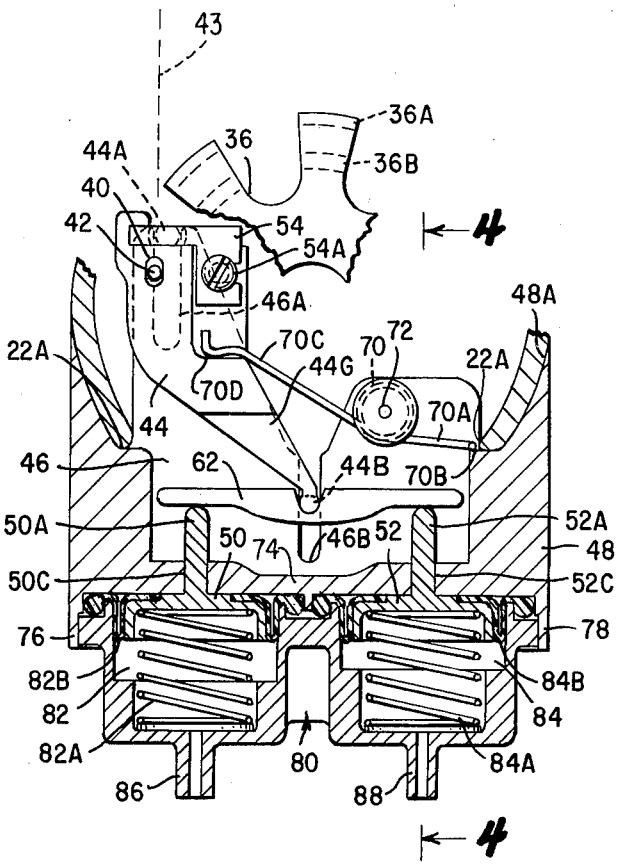
Figure 5:
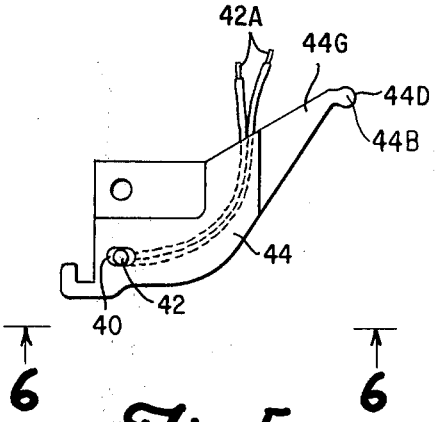
Figure 6:
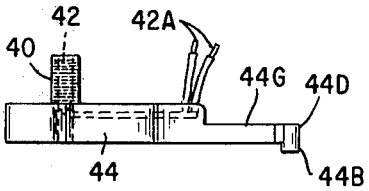
Figure 7:
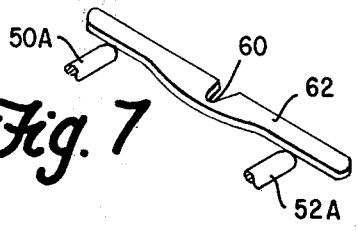
Figure 4:
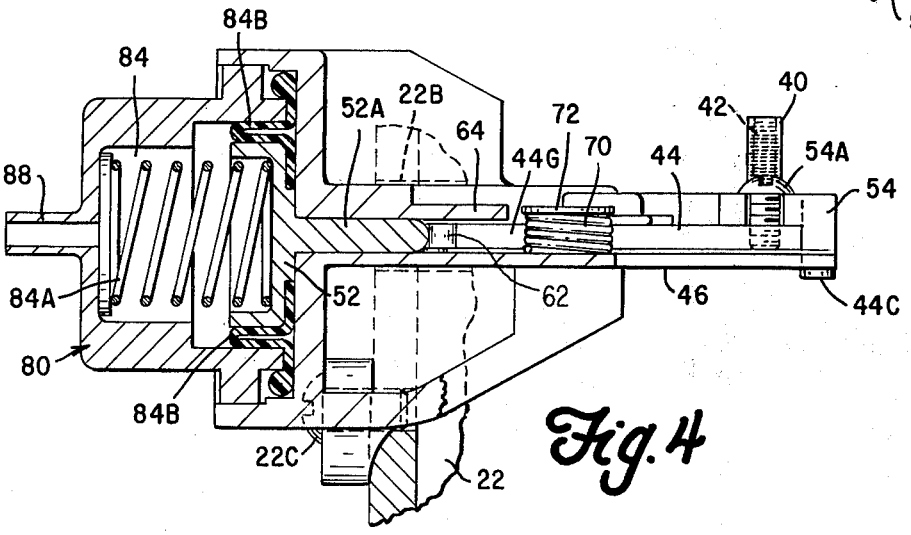

FIG. 1 is an elevational view partly in section of a distributor to which the invention has been applied, FIG. 2 is a plan view of the distributor shown in FIG. 1, FIG. 3 is a plan view taken along the line 3—3 of FIG. 1, FIG. 4 is an elevational view taken along line 4—4 of FIG. 3, FIG. 5 is a plan view of an operative element of the device, FIG. 6 is an elevational view taken along line 6—6 of FIG. 5, FIG. 7 is an isometric view of an equalizing yoke of the operating linkage, FIG. 8 is a plan view of the distributor rotor, FIG. 9 is a sectional view taken along line 9—9 of FIG. 8, FIG. 10 is a plan view of elements shown in FIG. 3, and FIG. 11 is an elevational view of the elements shown in FIG. 10 taken along line 11—11.

The device described hereinafter is an improvement over that shown in French Pat. No. 514,206.

Referring to the drawings particularly to FIG. 1, a conventional distributor 20 is shown to which the invention has been applied comprising a housing 22 fitted with a conventional plastic cover 24 having eight towers 26 for an eight-cylinder automobile. A central tower 28 is provided for a high tension lead (not shown) to provide sparking voltages to the leads for the spark plugs of the engine connected by suitable leads with the towers 26. The plastic cover 24 is held in position on the housing 22 by steel clamping springs 30 as seen in FIG. 2. The housing 22 is provided with a depending tubular neck 22A by which the distributor is attached to the engine block in a conventional manner. An engine-driven shaft 32 is journalled in the neck 22A to drive a conventional centrifugal advance device 34 which rotates a timing rotor 36 with reference to the shaft 32 in accordance with speed of rotation to advance the timing of the spark ignition for the engine. These distributor elements are conventional including the spark distributing rotor (not shown) which establishes an electrical connection at the upper end for the different cylinders of the engine.

The present invention is concerned with the vacuum advance devices of the distributor disclosed wherein the advance of the spark ignition is controlled by a predetermined relation between two negative pressures created by the engine during its operation at various speeds and loads. The ignition system with which the distributor is intended to be used, is a breakerless type, such as disclosed in U.S. Pat. No. 3,316,448, wherein a small coil 40 positioned on a vertical ferrite stud 42 affixed to a movable plate 44 is movable along a line 43 tangential to a circle defined by rotation of a point between flange portions 36A and 36B of the timing rotor 36 (as is best seen in FIG. 3) to change the physical relations in an electronic ignition circuit to control the timing of the ignition spark. The changes in the electrical circuit are sensitive to the proximity of a conductive material (not necessarily magnetic) to the coil 40 which is provided by a pair of concentric, depending peripheral flange portions 36A and 36B (See FIG. 9) which simultaneously enter into a spatial relation with the coil 40 to change the electrical parameters of an oscillating circuit cooperating with the coil by leads 42A (FIG. 5). An electrical pulse is created in the electronic circuit which triggers the electrical spark of an ignition circuit. The centrifugal device 34 rotates the timing rotor 36 with reference to the driving shaft 32 to control the timing in relation to speed of rotation while the movement on the tangential line 43 by the coil 40 controls the timing of the spark with reference to load or other parameters of the engine.

The movable plate 44 on which the coil 40 is mounted for straight-line motion along the tangential line 43, is mounted in turn on a plate 46 which projects into the distributor housing 22 through aperture 22B and includes an integral molded member 48 of suitable plastic material such as a nylon or polyester. Plate 46 is adapted to be fabricated as a subassembly and inserted into the aperture 22A already described and fastened in permanent position to the distributor 22 by a screw 22C shown in FIG. 4, where the screw is threaded into an aperture in the distributor housing. The molded member 48 is molded on its forward face 48A to embrace the exterior of the circular distributor housing 22 to form a weather seal therewith, as best seen in FIG. 3. The outer portion of the member 48 is conformed to provide a supporting base for a pair of pressure responsive pistons 50 and 52 which will be described in further detail hereinafter.

The movable plate 44 is provided with depending portions 44A and 44B, which interlock and move along parallel slots 46A and 46B molded into the plate 46 as best seen in FIG. 3. Portion 44A has an interlocking head 44C as shown in FIGS. 10 and 11 and is formed as a part of angular member 54 held in assembled position on plate 44 by screw 54A, for convenient interlocking assembly of the parts. The depending portion 44B is positioned on an oblique rearwardly projecting arm 44G (FIG. 6), integral with the movable plate 44, having a cylindrical end face 44D forming a bearing surface concentric with the depending portion 44B, which cooperates with a central rounded slot 60 in a summing yoke 62 which slides on the upper surface of plate 46 being also held in this relation by an upper parallel plate 64 as best seen in FIG. 4. The yoke ends cooperate with the rounded ends of pintles 50A and 52A integral with the pressure-responsive pistons 50 and 52 already alluded to above. The yoke is thereby adapted for limited rotation around the rounded end 44D on the end of the arm 44G to summate and average the movements of the pistons 50 and 52 to control the position of the coil 40 in its resulting movement along line 43 to vary the ignition timing in a predetermined manner. Thus, due to the urging of bias spring 70 the coil is caused to move a distance equal to one-half the sum of the individual piston motions.

The pintles 50A and 52A extend loosely through central apertures 50C and 52C in the vertical wall 74 of the molded member 48 to cooperate with the arms of the yoke 62 as already described. The outer side of the vertical wall 74 is provided with annular flanges 76 and 78 which are concentric with the central apertures 50C and 52C to form chambers for the pistons 50 and 52. Seated within the annular flanges 76 and 78, a single molded member 80 is provided which forms two pressure chambers 82 and 84 in communication with outer hose nipples 86 and 88 which allows the application of negative pressures thereto from selected sources in the engine to which the distributor is attached. Compression springs 82A and 84A are provided in the chambers 82 and 84 to act in a direction to move the pistons 50 and 52 towards the yoke 62, against the bias of spring 70 which is of much lesser force. The pistons 50 and 52 are sealed by rolling diaphragms 82B and 84B in a well-known manner. The molded member 80 is held in position within the flanges 76 and 78 by rivets 80A (FIG. 2).

The timing rotor 36 shown in FIG. 8 is designed for use with an eight-cylinder engine having eight pairs of depending flanges 36A and 36B. It is mounted on a sleeve adapted for limited rotation relative to the main distributor shaft 32, which limited rotation is controlled by the centrifugal governor 34 as described above. The rotatable member 36 may be made of metal or of a plastic material covered with a thin metallic coating by any suitable method. The two depending flanges each cooperating with the coil 40 on opposite sides thereof compensate for wobble or eccentricity of other mechanical faults as compared to that shown in U.S. Pat. No. 3,316,448 referred to above.

The two negative pressures applied to the two pressure chambers 82 and 84 may be obtained from selected sources on the engine to compensate for various effects and are summated and averaged by the action of the yoke 62 to move the coil 40 to its advanced predetermined position along the line 43 by downward motion in a tangential direction (FIG. 3) with reference to the rotor member 36. Helical springs 82A and 84A, being stronger than spring 70, urge the pistons 50 and 52 and their integral pintles 50A and 52A upwardly (FIG. 3) until the pistons contact the tower face of the member 48 which predetermines the retarded initial position of the coil 40 with reference to the rotor 36. Changes in altitude or exhaust gas recirculation or other engine parameters can be utilized for sources of negative pressure.

I claim:

1. A dual vacuum advance distributor for an engine comprising a timing rotor, a movable member, a coil carried by said movable member, said movable member being adapted to move said coil generally tangentially relative to said rotor, first and second actuators which are independently operable and are disposed for generally parallel movement and a proportioning yoke, said first actuator engaging said yoke so that movement of said first actuator causes movement of said yoke, said second actuator engaging said yoke remotely from said first actuator so that movement of said second actuator causes movement of said yoke independently of the movement caused by said first actuator, said yoke engaging said movable member intermediate said actuator engagement points, whereby any movement of said actuators is summated and proportioned as it is transmitted to said movable member by said yoke.

* * * * *